US005911263A

United States Patent [19]

Wu

[11] Patent Number: 5,911,263

[45] Date of Patent: Jun. 15, 1999

[54] LOCKING DEVICE FOR COLLAPSIBLE LUGGAGE TROLLEYS

[76] Inventor: Mei-Kuei Wang Wu, No. 7, Lane 90, Chung-Shan N. Rd., Da-An Township, Taichung County, Taiwan

[21] Appl. No.: 09/066,592

[22] Filed: Apr. 27, 1998

[51] Int. Cl.[6] ..... A47B 95/02

[52] U.S. Cl. ..... 16/115; 190/115; 280/47.315

[58] Field of Search ..... 16/115; 190/18 A, 190/18 R, 14, 15 R, 115; 280/47.315, 47.317, 655, 655.1

[56] References Cited

U.S. PATENT DOCUMENTS

| | | | |
|---|---|---|---|
| 5,459,908 | 10/1995 | Chen | 16/115 |
| 5,584,097 | 12/1996 | Lu | 16/115 |
| 5,630,250 | 5/1997 | Chou | 16/115 |
| 5,729,866 | 3/1998 | Chg | 16/115 |

*Primary Examiner*—Chuck Y. Mah
*Attorney, Agent, or Firm*—Rosenberg, Klein & Bilker

[57] ABSTRACT

A locking device is provided for a collapsible luggage trolley of the type having a pair of outer tubes, a pair of inner tubes respectively, telescopically received in the outer tubes, and an operative handle connected to upper ends of the inner tubes. The locking device includes a rack formed on the inner periphery of one of the outer tubes. A rod is mounted in one inner tube which is telescopically received in the outer tube. The rod includes an upper end operably connected to the operative handle to move therewith. A latching device includes a link having an upper end securely connected to a lower end of the rod to move therewith, a plate member mounted to a lower end of the link and including two lateral walls each having an inclined slot defined therein, and a latch block including two protrusions formed on two lateral sides thereof and slidably received in the inclined slots of the plate member, respectively. The latch block further includes two teeth formed on a side thereof for releasably engaging with the rack on the outer tube. A box houses the rod and the plate member and defines a notch through which the teeth of the latch block is passable. A spring is mounted around the link and has two ends respectively attached to the plate member and the box for biasing the teeth of the latch block to engage with the rack.

1 Claim, 7 Drawing Sheets

LOCKING DEVICE FOR COLLAPSIBLE LUGGAGE TROLLEYS

BACKGROUND OF THE INVENTION

1. Field of the Invention

The present invention relates to an improved locking device for luggage trolleys.

2. Description of the Related Art

A typical collapsible luggage trolley includes a pair of outer tubes, a pair of inner tubes telescopically received in the outer tubes, respectively, and a handle securely connected to upper ends of the inner tubes. FIG. 6 of the drawings illustrate a prior art locking device for luggage trolleys which includes a rod 60 mounted in an inner tube 400 which, in turn is telescopically mounted in an outer tube 40. A positioning tube 50 is mounted between the inner tube 400 and the outer tube 40 and is threadedly engaged with the inner tube 400 to move therewith. The positioning tube 50 includes a bottom board 52 on which a latch block 62 is slidably mounted under the action of a spring 64. An actuating block 61 is glued to a lower end of the rod 60 to move therewith. When the press rod 60 is pushed downwardly under operation of a handle (not shown) connected to an upper end thereof, an inclined surface 610 of the actuating block 61 bears against an inclined surface 620 of the latch block 62 and thus causes a latch end 63 of the block 60 to disengage from one of a number of openings 41 defined in the outer tube 40 to thereby allow position adjustment of the inner tube 400 relative to the outer tube 40. After completion of such adjustment, the rod 60 is released, and the latch end 63 of the latch block 62 is re-engaged with another opening 41 of the outer tube 40 under the action of the spring 64. Nevertheless, such a positioning device is too complicated and thus is inconvenient and time-consuming to assemble. In addition, it is difficult to disengage the latch block 62 from the outer tube 400 as the friction between the blocks 61 and 62 and between the block 62 and the bottom board 52 is relatively large. Further, the actuating block 61 is adhered to the press rod 60 by glue and thus may fall off the press rod 60 after a period of time.

FIG. 7 of the drawings illustrates another prior art locking device for collapsible luggage trolleys in which the outer tube 70 includes a longitudinal rack 71 formed on an inner periphery thereof, and a gear 73 is rotatably mounted to the inner tube 72. A block 75 is connected to a lower end of a rod 74 operable by a handle button 79. The button 79 is mounted to a handle 78 which, in turn, is mounted to upper ends of the inner tubes 72. When the button 79 is pressed, the block 75 is lifted upwardly and thus disengaged from the gear 73 to thereby allow movement of the gear 73 along the rack 71 for adjusting position of the inner tube 72 relative to the outer tube 70. When the button 79 is released, the block 75 is moved downwardly under the action of a spring 76 to engage with the gear 73 and thus position the inner tube 72. Yet, mounting of the gear 73 onto the inner tube 72 is inconvenient and time-consuming. In addition, the wall thickness of the inner tube 72 is relatively thin and thus may be damaged by the gear shaft 73'. Further, the gear 73 must be processed with high precision, which is also inconvenient and time-consuming as well as costly.

The present invention is intended to provide an improved locking device which mitigates and/or obviates the above-mentioned problems.

SUMMARY OF THE INVENTION

In accordance with the present invention, a locking device is provided for a collapsible luggage trolley of the type having a pair of outer tubes, a pair of inner tubes respectively, telescopically received in the outer tubes, and an operative handle connected to upper ends of the inner tubes.

The locking device comprises a rack formed on the inner periphery of one of the outer tubes. A rod is mounted in one inner tube which is telescopically received in the outer tube. The rod includes an upper end operably connected to the operative handle to move therewith. The rod is longitudinally movable in the inner tube under operation of the operative handle. A latching means is provided and includes a link having an upper end securely connected to a lower end of the rod to move therewith, a plate member mounted to a lower end of the link and including two lateral walls each having an inclined slot defined therein, and a latch block including two protrusions formed on two lateral sides thereof and slidably received in the inclined slots of the plate member, respectively. The latch block further includes a toothed means formed on a side thereof for releasably engaging with the rack on the outer tube. A box houses the rod and the plate member and defines a notch through which the toothed means of the latch block is passable. In addition, a spring is mounted around the link and has two ends respectively attached to the plate member and the box for biasing the toothed means of the latch block to engage with the rack.

By such an arrangement, the toothed means of the latch block is biased by the spring to engage with the rack when the rod is in a lower position to retain the inner tube in position. When the rod is lifted to a higher position under operation of the operative handle, the plate member and the link are lifted upwardly such that the toothed means of the latch block is disengaged from the rack under movements of the protrusions guided by the inclined slots to thereby allow position adjustment of the inner tube relative to the outer tube.

Other objects, advantages, and novel features of the invention will become more apparent from the following detailed description when taken in conjunction with the accompanying drawings.

DESCRIPTION OF THE PREFERRED EMBODIMENT

Figure 1:
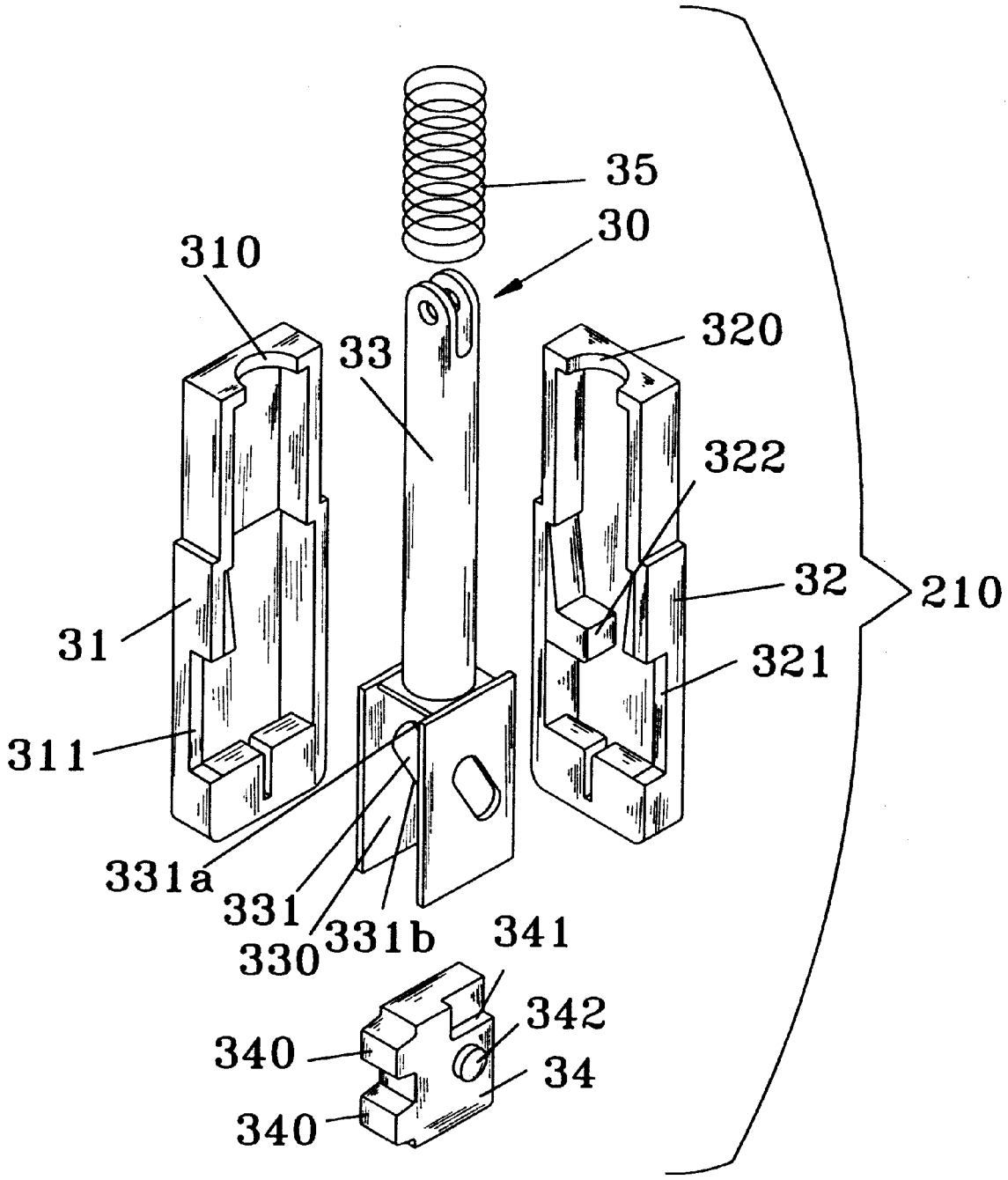
FIG. 1 is an exploded perspective view of a locking device for collapsible luggage trolleys in accordance with the present invention.
Figure 2:
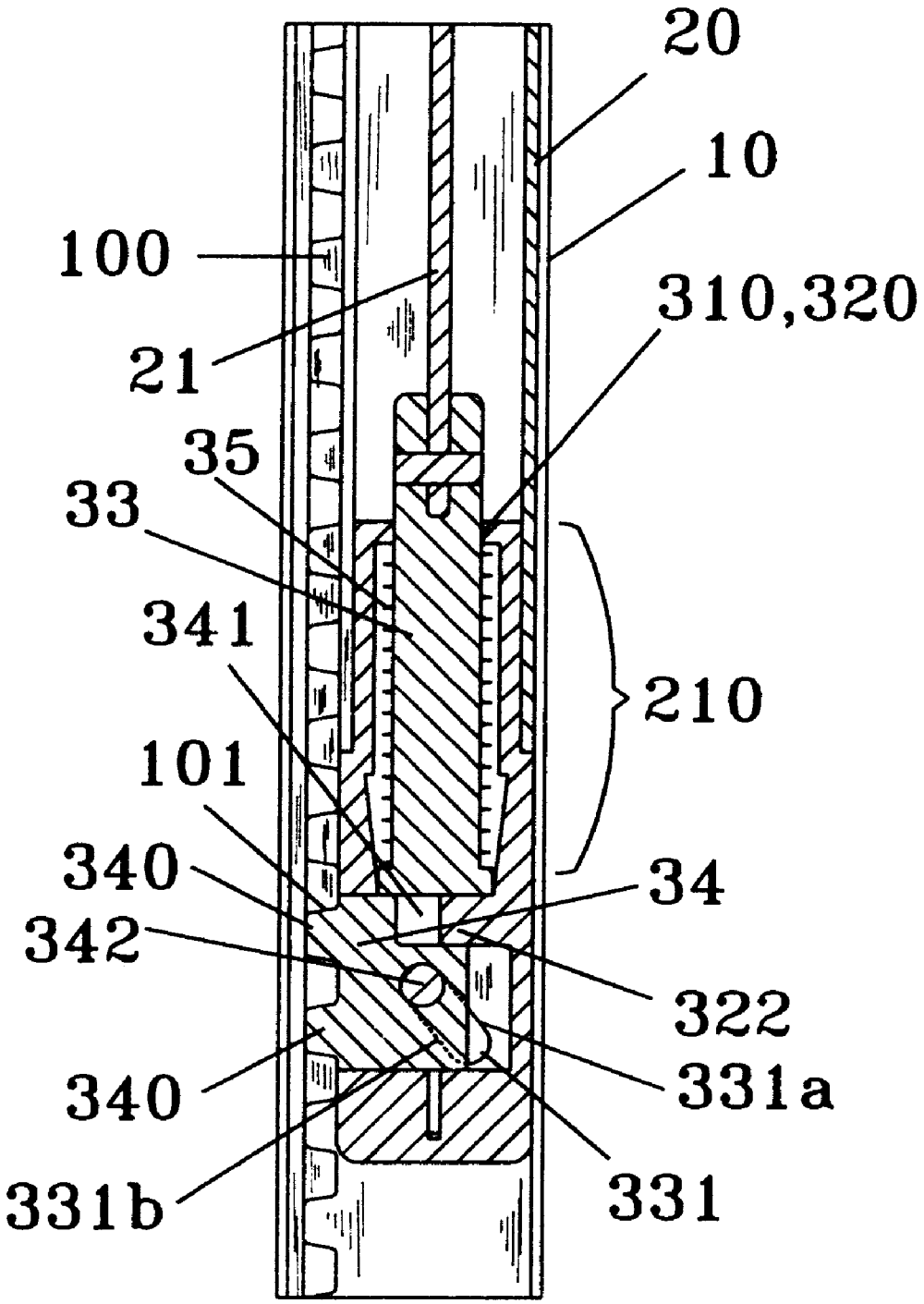
FIG. 2 is a sectional view of the locking device mounted in an inner tube and an outer tube of a collapsible luggage trolley.
Figure 3:
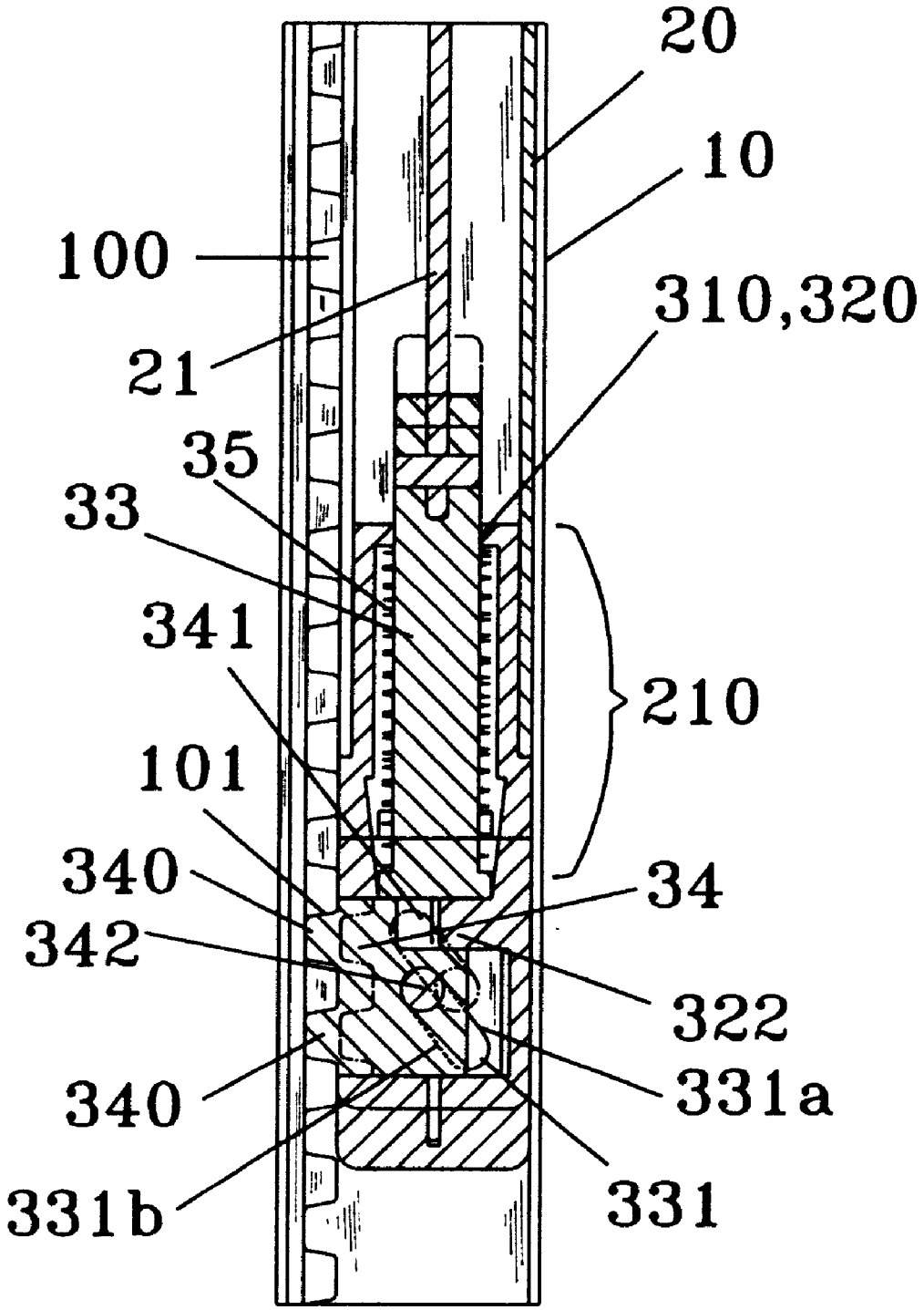
FIG. 3 is a sectional view similar to FIG. 2, illustrating operation of the locking device.
Figure 4:
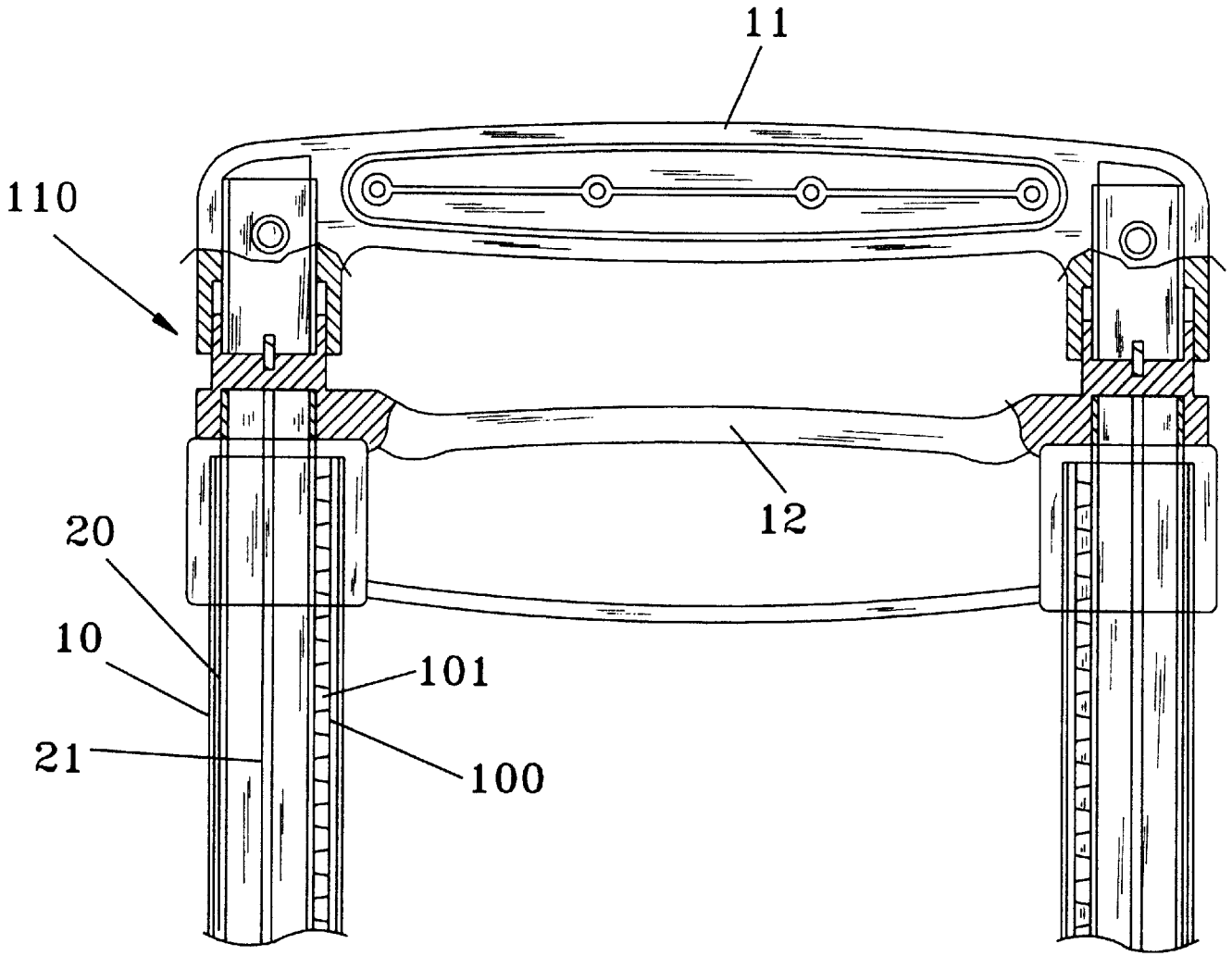
FIG. 4 is a sectional view showing upper ends of the inner and outer tubes and a handle.
Figure 5:
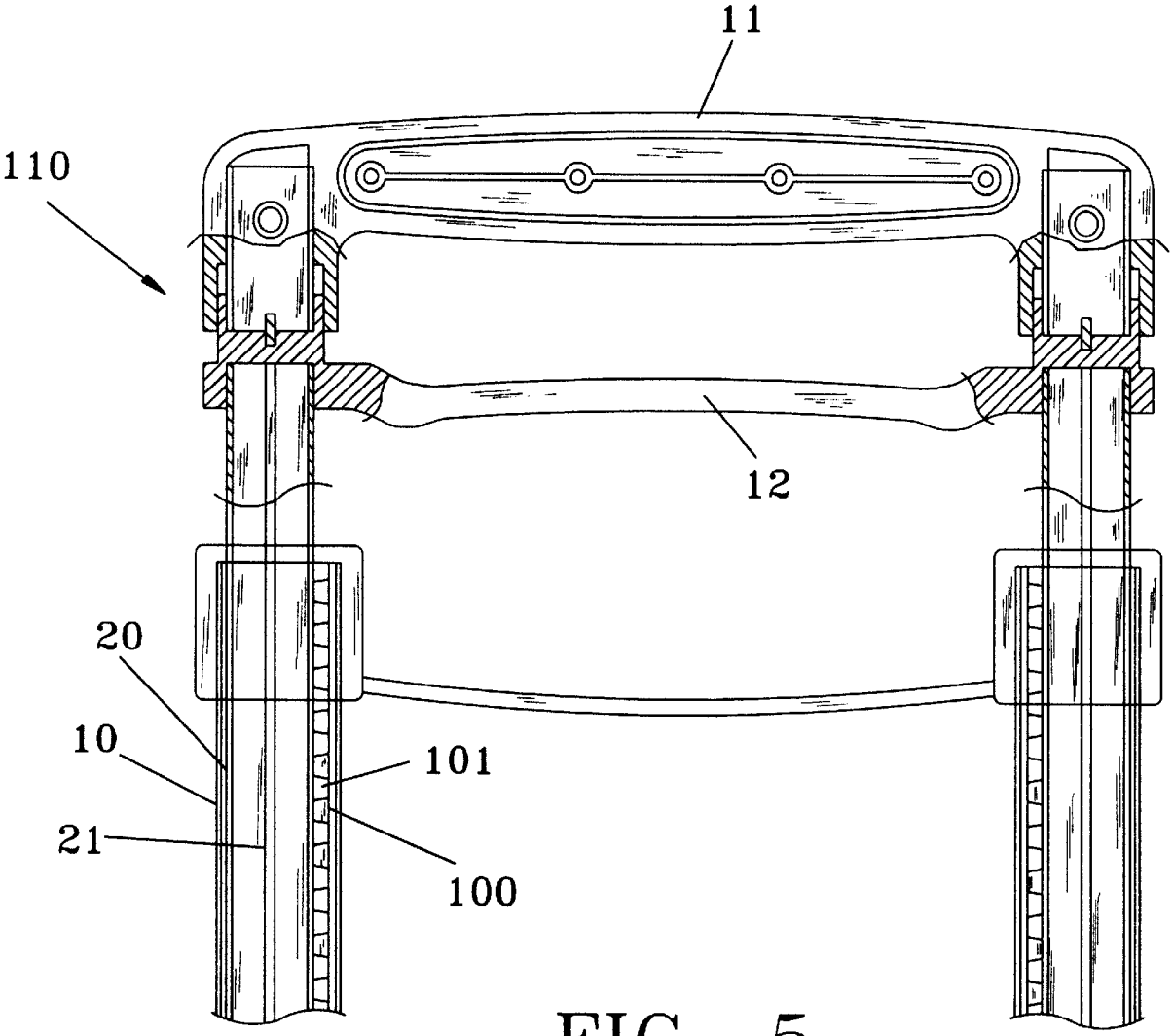
FIG. 5 is a section view similar to FIG. 4, illustrating operation of the handle.
Figure 6:
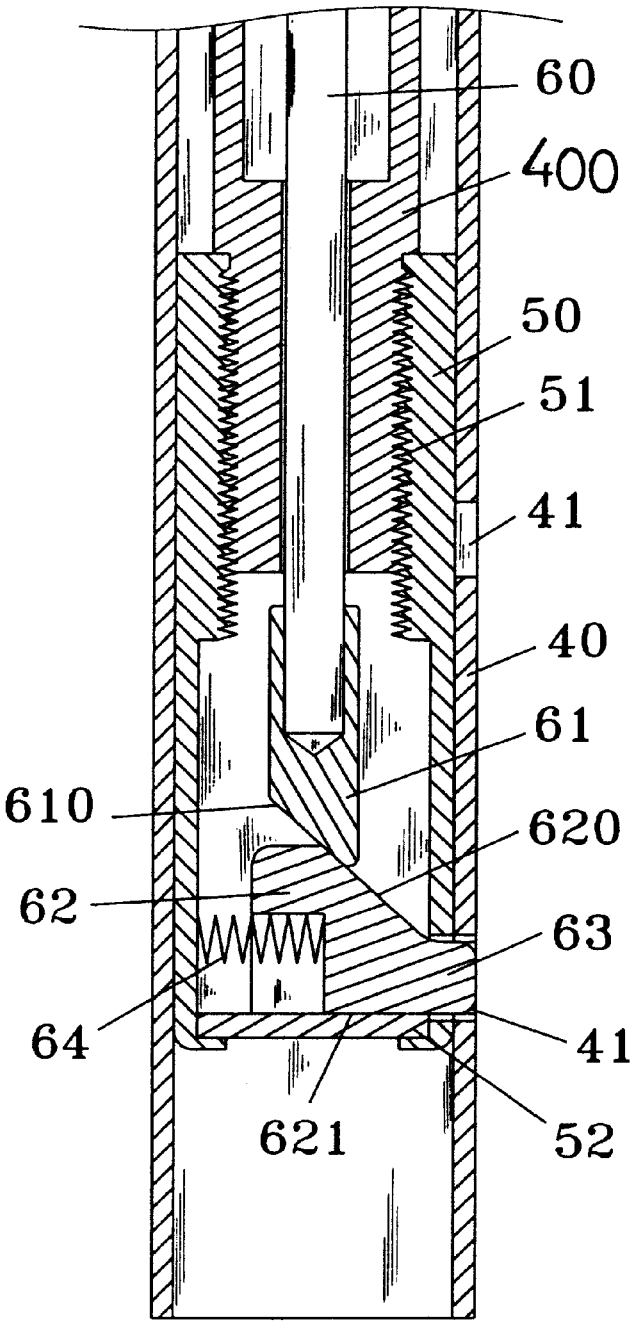
FIG. 6 PRIOR ART
FIG. 6 is a sectional view illustrating a prior art locking device.
Figure 7:
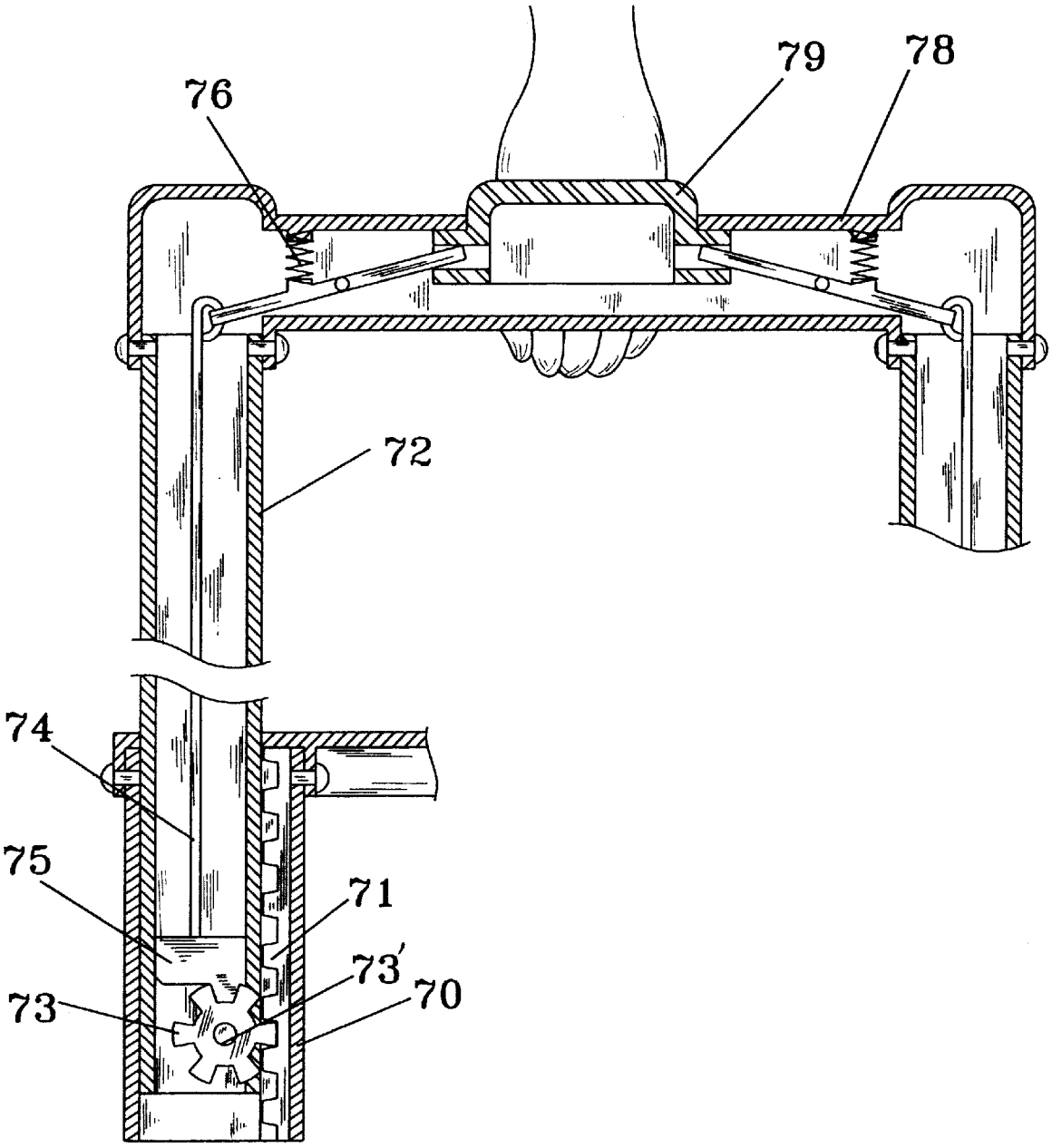
FIG. 7 PRIOR ART
FIG. 7 is a sectional view illustrating another prior art locking device.

Referring to FIGS. 1 to 5 of the drawings and initially to FIGS. 2 and 4, a locking device in accordance with the present invention is applied to a collapsible luggage trolley of the type having a pair of outer tubes 10, a fair of inner tubes 20 telescopically received in the outer tubes 10, respectively, and a handle 11 mounted to upper ends of the inner tubes 20. Referring to FIGS. 1 and 2, the locking device generally includes a rod 21 mounted in each inner tube 20 and includes an upper end operably connected to the handle 11. The user may lift a bar 12 (FIG. 4) mounted below the handle 11 and connected to the upper end of tile rod 21 to lift the inner tube 21 upwardly or release the bar 12 such that the inner tube 21 moves downwardly. The outer tube 10 includes a rack 100 mounted to an inner periphery thereof, which will be described later.

Mounted to a lower end of the rod 21 is a latching means 210 which includes a box 30 consisting of two half casings 31 and 32. Each half casing 31, 32 include an opening 310, 320 defined in an end thereof through which a link 33 is extended. Each half casing 31, 32 further includes a notch 311, 321 defined in a side thereof through which a latch block 34 is extended. The half casing 32 further induces a flange 322 formed therein, which will be described later. The link 33 includes a spring 35 mounted therearound and includes an upper end connected to the lower end of the rod 21 and a lower end to which a substantially U-shaped plate member 330 is mounted. The plate member 330 includes two lateral walls each having an inclined slot 331 defined therein, wherein each inclined slot 331 includes an upper lateral edge 331*a* and a lower lateral edge 331*b*. The latch block 34 includes a shoulder 341 to engage with the flange 322 and two protrusions 342 respectively formed on two lateral sides thereof so as to be slidably received in the inclined slots 331, respectively. The latch block 34 further includes two teeth 340 projecting outwardly from a side thereof.

It is appreciated that the rod 21 and the associated latch means 210 may be mounted in only one of the inner tubes 21 without adversely affecting the function. And the assembly and operation of the locking device will be described hereinafter with reference to an inner tube 20 and an outer tube 10 only.

In assembly, referring to FIGS. 1 to 3, the latch means 210 is connected to the inner tube 20, where in the spring 35 is firstly mounted around the link 33, and the link 330 and the plate member 330 are placed into the half casing 31 yet the distal end of the link 33 extends beyond the half casing 31 via the opening 310 while two ends of the spring 35 bear against the upper end of the half casing 31 and the place member 330, respectively. The block 34 is then mounted between the lateral sides of the plate member 330 with the protrusions 342 received in the inclined slots 331, respectively. Thereafter, the other half casing 32 is mounted to enclose the link 33 and the plate member 3:30 in which the flange 322 of the half casing 32 engages with the shoulder 341 of the latch block 34. The upper ends of the half casings 31 and 32 are finally secured to a lower portion of an inner periphery of the rod 21.

In use, the link 33 and the plate member 330 are initially in a status shown in FIG. 2 (the bar 12 is rot lifted, see FIG. 4) under the action of the spring 35, in which the upper lateral edges 331*a* of the inclined slots 331 of the plate member 330 bear against the protrusions of the latch block 34 such that the teeth 340 of the latch block 34 engage with the teeth 101 of the rack 100 on the outer tube 10. As a result, the inner tube 20 is positioned relative to the outer tube 10.

When the user lifts the bar 12 below the handle 11 (FIG. 5), the rod 21 is lifted upwardly such that the link 33 and the plate member 330 are also lifted. Lower lateral edges 331*b* of the inclined slots 331 of the plate member 330 exert a force on the protrusions 342 of the latch block 34 to thereby cause the latch block 34 to move away from the rack 100. As a result, the teeth 340 of the latch block 34 disengage from the rack 100 to thereby allow position adjustment. of the inner tube 20 relative to the outer tube 10, as shown in FIG. 3. When the adjustment is completed, the bar 12 is released, the latch block 34 is moved to reengage with the rack 100 under the action of the spring 35 to thereby position the inner tube 20.

According to the above description, it is appreciated that the locking device in accordance with the present invention includes the following advantages:

(1) the structure and assembly are simple;

(2) positioning control of the inner tube is easy under the provision of the inclined slots 330 and the protrusions 342; and (3) the teeth 340 on the latch block 34 may reliably engage with the teeth 101 of the rack 100 to position the inner tube 20.

Although the invention has been explained in relation to its preferred embodiment, it is to be understood that many other possible modifications and variations can be made without departing from the spirit and scope of the invention as hereinafter claimed.

What is claimed is:

1. A locking device for a collapsible luggage trolley of the type having a pair of outer tubes each having an inner periphery, a pair of inner tubes respectively, telescopically received in the outer tubes arid each having an inner periphery, and an operative handle connected to upper ends of the inner tubes, the locking device comprising:

a rack formed on the inner periphery of one of said outer tubes, a rod mounted in one of said inner tubes which is telescopically received in said one outer tube, said rod including an upper end operably connected to the operative handle to move therewith and a lower end, the rod being longitudinally movable in said one inner tube under operation of the operative handle, and a latching means including:

a link having an upper end securely connected to the lower end of the rod to move therewith and a lower end, a plate member mounted to the lower end of the link and including two lateral walls each having an inclined slot defined therein, a latch block including two protrusions formed on two lateral sides thereof and slidably received in the inclined slots of the plate member, respectively, the latch block further including a toothed means formed on a side thereof for releasably engaging with the rack on the outer tube, a box for housing the rod and the plate member, the box defining a notch through which the toothed means of the latch block is passable, and a spring mounted around the link and having two ends respectively attached to the plate member and the box for biasing the toothed means of the latch block to engage with the rack, whereby the toothed means of the latch block is biased by the spring to engage with the rack when the rod is in a lower position to retain the inner tube in position, and when the rod is lifted to a higher position under operation of the operative handle, the plate member and the link are lifted upwardly such that the toothed means of the latch block is disengaged from the rack under movements of the protrusions guided by the inclined slots to thereby allow position adjustment of the inner tube relative to the outer tube.

* * * * *